United States Patent [19]

Kikuchi et al.

[11] Patent Number: 4,750,881

[45] Date of Patent: Jun. 14, 1988

[54] EASILY ASSEMBLED CARRIAGE MECHANISM OF PRINTER

[75] Inventors: Hiroshi Kikuchi; Kazuki Obara; Kuniharu Hayashi; Masanori Maekawa; Yukio Ota; Shyoichi Watanabe, all of Tokyo, Japan

[73] Assignee: Oki Electric Industry Co., Ltd., Tokyo, Japan

[21] Appl. No.: 836,511

[22] Filed: Mar. 5, 1986

[30] Foreign Application Priority Data

Mar. 7, 1985 [JP] Japan ..... 60-31543[U]
Mar. 18, 1985 [JP] Japan ..... 60-37449[U]

[51] Int. Cl.[4] ..... B41J 29/02; B41J 33/14

[52] U.S. Cl. ..... 400/352; 400/229; 400/320; 400/692; 439/495

[58] Field of Search ..... 400/229, 320, 322, 352, 400/353, 354, 355, 691, 692, 693, 693.1, 223, 225; 339/17 F, 17 M, 17 LM, 103 R, 103 M

[56] References Cited

U.S. PATENT DOCUMENTS 3,588,615 6/1971 Brearly et al. ..... 339/17 M
3,701,071 10/1972 Landman ..... 339/17 M
4,452,542 6/1984 Akazawa ..... 400/692
4,526,486 7/1985 Kikuchi et al. ..... 400/229
4,538,865 9/1985 Wakabayashi et al. ..... 339/17 F
4,613,246 9/1986 Sugiura et al. ..... 400/320

FOREIGN PATENT DOCUMENTS 1897 5/1979 European Pat. Off. ..... 339/17 M
2913683 10/1980 Fed. Rep. of Germany ..... 400/352

*Primary Examiner*—David Wiecking
*Attorney, Agent, or Firm*—Wenderoth, Lind & Ponack

[57] ABSTRACT

A carriage mechanism of a printer includes a carriage frame, a printed circuit board mounted on the carriage frame and having an exposed wiring portion and a plurality portion of guide holes, and a cable having at one end thereof an exposed wiring portion to be electrically connected to the exposed wiring portion of the printed circuit board. An inked ribbon feed mechanism has guide projections to be inserted into the guide holes and a plurality of elastic hooks for fastening to the carriage frame. A cable fixing mechanism includes a flexible film member to be superimposed over the end of the flexible cable and fixed thereto. One end of the flexible film member is shaped as the end of the flexible cable and the other end of the flexible film member is progressively narrower and projects toward a folded portion of the flexible cable.

7 Claims, 5 Drawing Sheets

EASILY ASSEMBLED CARRIAGE MECHANISM OF PRINTER

BACKGROUND OF THE INVENTION

1. Field of the Invention

The present invention relates to a printer for printing characters and symbols, etc., on a printing medium while moving a carriage having a printing head thereon in the printing line direction.

2. Description of the Prior Art

Various types of printers are employed in information processing and business machines. One type of such printer frequently employed in recent years includes a printing head having many printing wires extending almost perpendicularly to the direction of a printing line and mounted on a carriage for movement in the direction of the printing line so that character data are printed on a printing medium one line at a time. This type of printer can be miniaturized and made light of weight, and thus is available at a low price. The printer selectively strikes the printing medium with printing wires via an inked ribbon for printing. A carriage of the printer having thereon an inked ribbon casing including the inked ribbon therein as well as a printing head including the printing wires thereon is moved in the direction of the printing line, while the printing medium is fed in a direction substantially perpendicularly to the direction of the printing line.

Although the carriage is moved in the direction of the printing line direction by use of a toothed belt and a screw shaft, another type of carriage, called a self-propelled carriage mechanism and employing a rack and a pinion for moving the carriage, has begun to be profitably employed.

Such a self-propelled carriage mechanism, as disclosed for example in U.S. Pat. No. 4,523,486, comprises in general an inked ribbon feed mechanism mounted on a carriage frame, and a flexible cable connected with this mechanism. A motor for self-propulsion of the mechanism is located on the lower surface of the carriage frame. Pinions are attached to opposite ends of a shaft of the motor, a lower of the pinions being engaged with a rack mounted on a printer frame to propel the mechanism, and an upper of the pinions being engaged with a gear of the inked ribbon feed mechanism for feeding an inked ribbon. Thus, the self-propelled carriage mechanism is arranged such that a movable body is connected with a flexible cable.

Such arrangement includes attaching the inked ribbon feed mechanism to the carriage frame by screws, and inserting a plug at the end of the flexible cable into a socket provided on the carriage frame for electrical connection. Moreover, although a ribbon cable or the like may be employed, hereinafter such is referred to by the term flexible cable.

However, with this known carriage mechanism, the inked ribbon mechanism must be attached to the carriage frame by screws to assemble a printer. For this, alignment of tapped holes with screws is required together with screwing of screws into the tapped holes. That is, in an assembly line process of automatic assembly, such operations as longitudinal and transversal positioning of tapped holes and screws, insertion of the screws into the tapped holes, and rotation for screwing the screws into the holes are needed. These operations are complicated and cause the assembly line to become intricate because of the many operating processes required therefor. Furthermore, the socket and the plug must be aligned with each other for a subsequent insertion operation, and this likewise is complicated.

In addition, such prior carriage mechanism has another disadvantage that repetitive bending of a flexible cable due to reciprocating movement of the carriage causes bending stress to be concentrated in the vicinity of a connection portion between the flexible cable and the plug. As a result, the conductor pattern is sharply deteriorated and can become disconnected near the connecting portion.

SUMMARY OF THE INVENTION

It is an object of the present invention to provide a carriage mechanism of a printer capable of being assembled by the constituent parts thereof being assembled in a single prescribed direction.

Another object of the present invention is to provide a carriage mechanism of a printer whereby it is possible to simplify an assembly line therefor by use of an extremely simple assembly operation requiring reduced assembly time.

Still another object of the present invention is to provide a carriage mechanism of a printer whereby it is possible to effect both wiring connecting and assembly of an inked ribbon feed mechanism onto a carriage frame with only a vertical operation from above to below.

A still further object of the present invention is to provide a carriage mechanism of a printer whereby a secure wiring connection is achieved.

A still further object of the present invention is to provide a carriage mechanism of a printer whereby the cost of assembly thereof is reduced because the number of parts and the time required for assembly operations can be decreased.

Still another object of the present invention is to provide a carriage mechanism of a printer capable of reducing bending stress concentrated in the vicinity of a connecting portion between the flexible cable and the movable body and thereby preventing a conductor pattern in the vicinity of the connecting portion from being disconnected.

To achieve the above objects, a carriage mechanism according to the present invention has an inked ribbon feed mechanism molded of synthetic resin material and including guide projections provided on the lower surface thereof and a plurality of hooks projecting downwardly from the periphery thereof, a carriage frame including guide holes formed at positions corresponding to the guide projections, a printed circuit board provided on the carriage frame and having wiring exposed to the outside at an end of the printed circuit board, and a flexible cable with wiring exposed in an end thereof.

Accordingly, the guide projections of the inked ribbon feed mechanism are vertically lowered so as to be aligned with the guide holes of the carriage frame, and the hooks are engaged with the peripheral edges of the carriage frame by making use of elasticity of the hooks, while the exposed portion of the wiring of the flexible cable is placed in overlapping fashion on the exposed portion of the wiring of the printed circuit board on the carriage frame, thus making electrical connection therebetween.

Further, a carriage mechanism according to the present invention includes a flexible film having one end formed in substantially the same shape as the shape of the end of the flexible cable, and another end progressibly narrower away from the one end. Such one end of the film member is superimposed over the end of the flexible cable connected with movable body and fixed thereto, and the free other end of the film member is projected in the direction of a folded portion of the flexible cable.

Accordingly, upon reciprocating movement of the movable body, the flexible cable is gently bent because upward movement of the cable is suppressed by the film member. Thereby, bending stress concentrated in the vicinity of a connecting portion between the flexible cable and the movable body is reduced, thereby preventing a conductor pattern in the vicinity of the connecting portion from being disconnected.

The present invention will be described with reference to the accompanying drawings, wherein similar elements are identified by the same reference numerals.

DESCRIPTION OF THE PREFERRED EMBODIMENT

Figure 1:
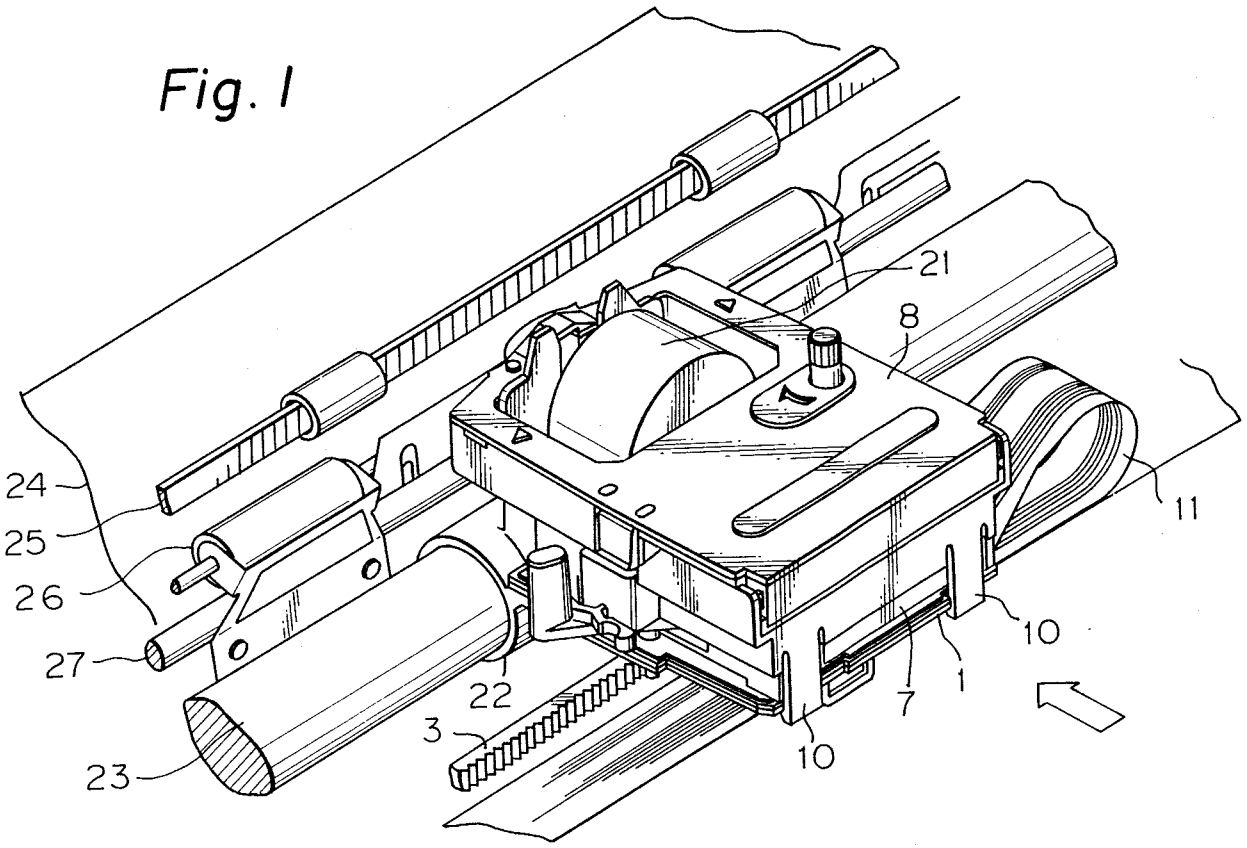
FIG. 1 is a perspective view of a portion of a self-propelled carriage mechanism mounted on a printer according to an embodiment of the present invention.
Figure 2:
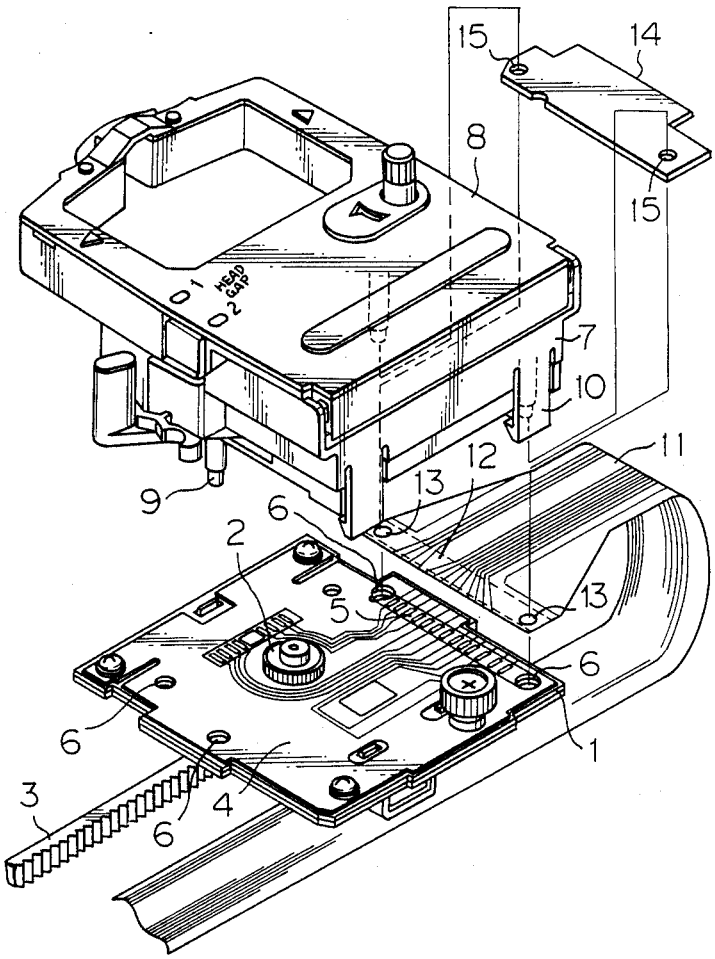
FIG. 2 is an exploded perspective view of a self-propelled carriage mechanism of such embodiment of the present invention.
Figure 3:
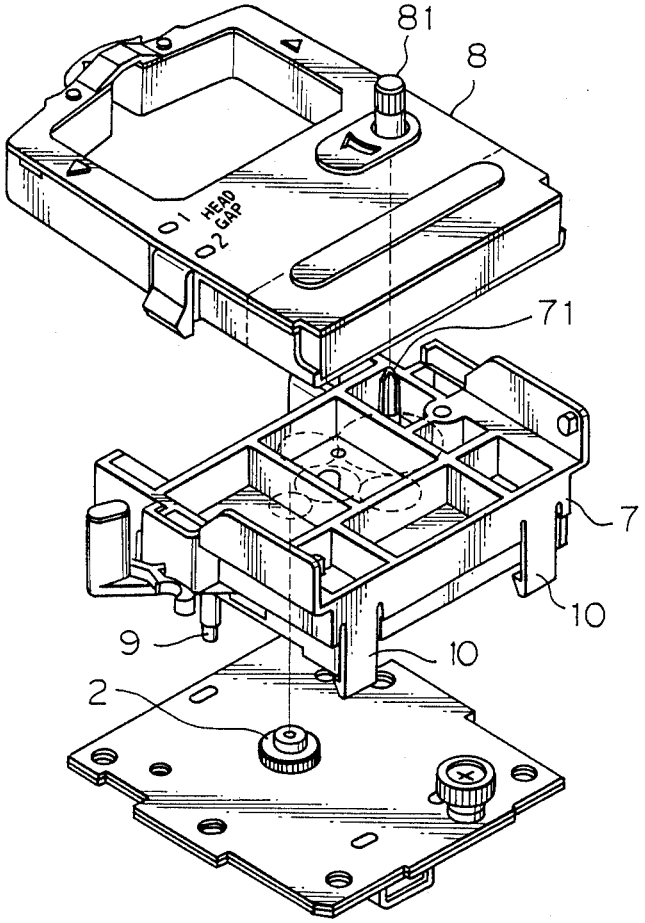
FIG. 3 is a further exploded perspective view of the self-propelled carriage mechanism of such embodiment of the present invention.

FIG. 1 shows a main portion of a printer, FIG. 2 is an exploded view of a self-propelled carriage mechanism, and FIG. 3 is a further exploded perspective view of the carriage mechanism. In such figures, a carriage frame 1 has a motor (as shown at 20 in FIG. 5) mounted on the lower surface thereof. One end of the shaft of motor 20 projects above the surface of carriage frame 1 and has an upper pinion 2, and the other end of the shaft of motor 20 has a lower pinion (shown at 2*a* in FIG. 5) for meshing with a rack 3 and opposed to a roller (not shown) mounted on the lower surface of the carriage frame 1. The carriage frame 1 is moved longitudinally by the pinion 2*a* meshing with rack 3 with the roller and pinion 2*a* holding rack 3 therebetween. A printed circuit board 4 is mounted on the upper surface of the carriage frame 1 and an end of board 4 has an exposed wiring portion 5. Designated at 6 are a plurality of guide holes extending through carriage frame 1 and the printed circuit board 4, and two guide holes 6 are located adjacent ends of the exposed wiring portion 5.

A ribbon casing 8 having an inked ribbon and a gear for moving or taking up the ribbon is detachably mounted on an inked ribbon feed mechanism 7 integrally molded of synthetic resin material. Such gear is connected with a manual knob 81 for moving or taking up the ribbon and is engaged with a shaft 71 of the inked ribbon feed mechanism 7 so that the inked ribbon is moved or taken up by meshing engagement of the pinion 2 and the gear of casing 8 via a gear accommodating in the inked ribbon feed mechanism 7. The lower end of the inked ribbon feed mechanism 7 has guide projections 9 at positions corresponding to the guide holes 6 of the carriage frame 1. A plurality of hooks 10 extend downwardly from the lower end of the inked ribbon fed mechanism 7 and are V-shaped at inner peripheral side surfaces thereof and are slightly resiliently expandable outwardly.

The flexible cable 11 has an exposed wiring portion 12, and holes 13 for the insertion therethrough of respective of the guide projections 9 are provided at opposite lateral ends of the exposed wiring portion 12.

A mat member 14 made of silicon, rubber or the like for uniformly pressing the exposed wiring portion 12 of the flexible cable 11 has holes 15 aligned with holes 13 for the receipt of respective of the guide projections 9.

A printing head 21 is mounted on the carriage frame 1 by a means (not shown) and is disposed to be inserted into a recessed portion of the ribbon casing 8. The carriage frame 1 is fixed to a cylindrical mounting portion 22 which is slidably mounted on a guide shaft 23. The guide shaft 23 extends parallel to a platen (not shown) and thus the carriage frame 1 is movable along such platen, namely in the direction of a printing line. A printing medium 24 is urged by pressure rollers 26 toward the platen and is fed substantially perpendicularly to the direction of the printing line with the rotation of the platen. Upon winding or setting the printing medium 24 around or to the platen, rollers 26 are separated from the platen by operating a cam member 27. Upon effecting printing at a prescribed position of the printing medium 24, the printing medium 24 is set with use of a gauge of a column indicator 25.

Assembly of the above carriage mechanism is achieved in the following manner.

The projections 9 of the inked ribbon feed mechanism 7 are inserted through the holes 15 of the mat member 14. The holes 13 of the flexible cable 11 are aligned with the guide holes of the carriage frame 1. The inked ribbon feed mechanism 7 is superimposed over the carriage frame 1, and the guide projections 9 are guided and inserted through holes 13 and into the respective guide holes 6. At the same time, the hooks 10 are engaged with the lower side edges of the carriage frame 1 due to the resiliency of the ends of the hooks 10 expanding into L-shapes and thus snapping over the lower side edges of carriage frame 1. As a result, the inked ribbon feed mechanism 7 is integrally engaged with the carriage frame 1, and at the same time the position of the flexible cable 11 is fixed. Accordingly, the exposed wiring portions 5, 12 of the printed circuit board 4 and the flexible cable 11 are superimposed and electrically connected with each other.

Due to this arrangement, such electrical connection and the assembly of the inked ribbon feed mechanism with the carriage frame are achieved simultaneously with only a vertical operation from above to below without requiring conventional assembly operations in all directions and without requiring operations involving the rotation and driving of screws. Such simple assembly operation reduces the required processes at an assembly line and the time required therefor. Further, the number of parts to be assembled is reduced, thereby reducing the unit cost of the product.

Figure 4:
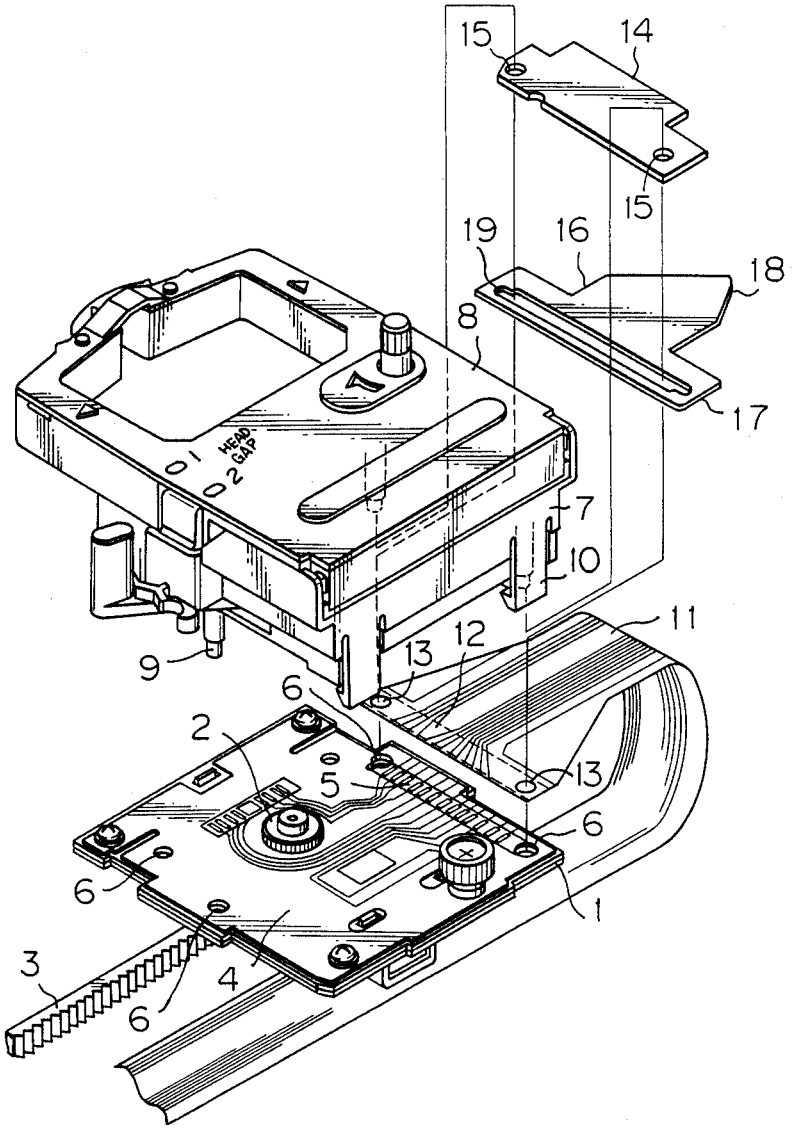
FIG. 4 is an exploded perspective view of another embodiment of the present invention.

FIG. 4 is an exploded view showing another embodiment of the self-propelled carriage mechanism of the present invention. A film member 16 is provided in this embodiment, in addition to the synthetic resin mat member 14 of the first embodiment. One end 17 of the film member 16 is formed in the same shape as that of the end portion of the exposed wiring portion 12 of the flexible cable 11. An elongated hole 19 is formed in end 17. The other end 18 of film member 16 is made progressively narrower in a direction away from end 17. The end 17 of the film member 16 is superimposed over the exposed wiring portion 12 of the flexible cable 11 and is held between the mat member 14 and the exposed wiring portion 12 in a sandwiched manner, with the other end 18 projecting in a direction of folding of the flexible cable 11 ( as shown in FIGS. 5(*a*) and (*b*)).

The elongated hole 19 provided in end 17 of the film member 16 acts to force the resilient mat member 14 to be pressed by the inked ribbon feed mechanism 7 so that some of the material of mat member 14 is pressed through opening 19 into direct contact with flexible cable 11, whereby each terminal of the flexible cable 11 is uniformly pressed into electrical connection with a corresponding terminal of the printed circuit board 4.

Operation of the second embodiment is described with reference to FIGS. 5(*a*) and (*b*).

Figure 5A:
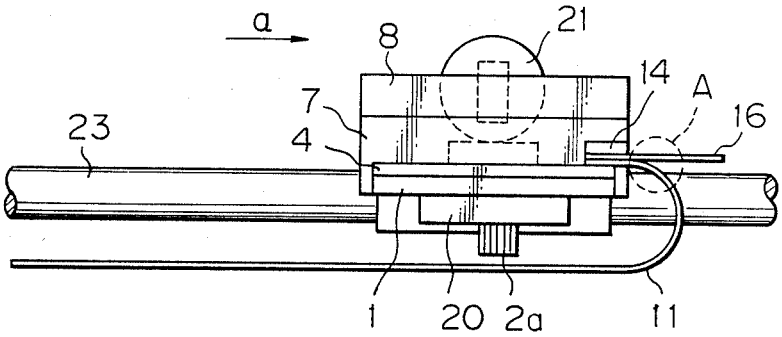
FIGS. 5(*a*) and (*b*) are elevation views showing a connection between a flexible cable and a movable body according to such other embodiment of the present invention.
Figure 5:
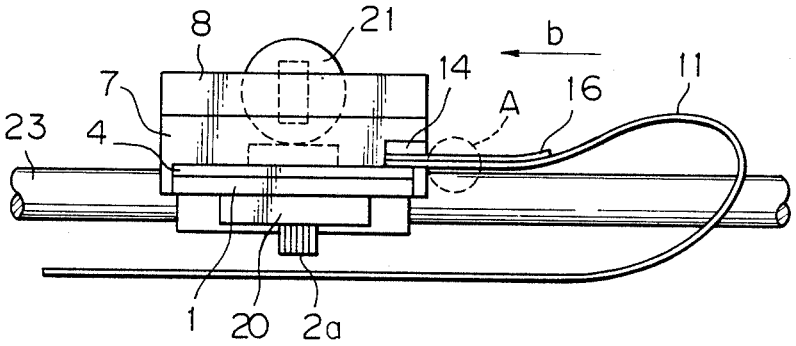

When motor 20 is forwardly rotated, the flexible cable 11 is moved with the carriage frame 1 in the direction of the arrow a as shown in FIG. 5(*a*) by the operation of pinion 2 and the rack 3 (shown in FIG. 4). The area of connection of the flexible cable 11 with the printed circuit board 4, i.e. area A, is bent downwardly as is conventional.

On the other hand, when the motor 20 is reversely rotated, the flexible cable 11 and the carriage frame 1 are moved in the direction of the arrow b as shown in FIG. 5(*b*), and the flexible cable 11 tends to bend upwardly. However, the area A of the flexible cable 11 is prevented from being bent upwardly by the film member 16 located above the area A. Further, since the film member 16 is progressibly narrower toward its end 18, the flexible cable 11 is gently bent upwardly adjacent end 18, thereby permitting the bending stress applied to the area A of the flexible cable 11 to be reduced.

According to this embodiment of the invention, end 17 of the film member 16 is held and fixed between one end of the flexible cable 11 and the mat member 14 in a sandwiching manner. If the terminals of the flexible cable 11 and the printed circuit board 4 are connected to each other by soldering, etc., then end 17 of the film member 16 may be superimposed over the end 12 of the flexible cable 11 and fixed thereto by bonding, etc., and since mat member 14 thereby would not be necessary, elongated hole 19 would not be necessary.

Although the above description is of a carriage mechanism of the self-propelled type driven by a motor accommodated in a movable body to which is fixed the flexible cable 11, the present invention is not limited thereto and can be applied to any movable body to which is to be made an electrical connection.

Further, a shape of the film member 16 is not limited to that wherein the portion other than end 17 substantially forms a pentagon as shown in FIG. 4. Such shape can be triangular, semicircular or semielliptical as long as the end 18 is made progressively narrower away from end 17.

We claim:

1. A carriage mechanism for a printer, said carriage mechanism comprising:

a carriage frame;

a printed circuit board mounted on said carriage frame and having an exposed wiring portion;

said printed circuit board and said carriage frame having therethrough aligned guide holes;

an electrical cable having at an end thereof an exposed wiring portion positioned on said exposed wiring portion of said printed circuit board;

an inked ribbon feed mechanism; and means for enabling said inked ribbon feed mechanism to be assembled to said carriage frame by a single manipulative operation in a single direction, and thereby for clamping said printed circuit board between said inked ribbon feed mechanism and said carriage frame and for clamping said end of said cable between said inked ribbon feed mechanism and said printed circuit board, with said exposed wiring portion of said cable pressed against and in electrical contact with said exposed wiring portion of said printed circuit board, said means comprising projections extending in said single direction from said inked ribbon feed mechanism into respective of said guide holes, and a plurality of integral elastic hook members extending in said single direction from said inked ribbon feed mechanism and elastically snapping over said edges of said carriage frame.

2. A mechanism as claimed in claim 1, further comprising an elastic mat member positioned between said end of said cable and said inked ribbon feed mechanism.

3. A mechanism as claimed in claim 2, wherein two of said guide holes are positioned adjacent lateral ends of said exposed wiring portion of said printed circuit board, said end of said cable has openings aligned with said two guide holes, said elastic mat member has openings aligned with said two guide holes, and two of said projections extend through respective said openings in said elastic mat member and said end of said cable and into respective of said two guide holes.

4. A mechanism as claimed in claim 1, wherein said cable is flexible.

5. A mechanism as claimed in claim 4, wherein said flexible cable is capable of folding upon movement of said carriage mechanism, and further comprising means for preventing stresses due to such folding from breaking said cable in the area of said end thereof.

6. A mechanism as claimed in claim 5, wherein said means comprises a flexible film member separate from said cable and having a first end of substantially the same shape as said end of said cable and positioned between said end of said cable and said inked ribbon feed mechanism, said film member having a second end of progressively narrower size in a direction away from said first end, said second end projecting outwardly from said inked ribbon feed mechanism over said cable.

7. A mechanism as claimed in claim 6, wherein said first end of said film member has therethrough an elongated opening, and further comprising an elastic mat member positioned between said first end of said film member and said inked ribbon feed mechanism, some of the material of said mat member being pressed through said elongated opening and pressing said end of said cable against said printed circuit board.

* * * * *